US006843069B2

(12) United States Patent
Harano et al.

(10) Patent No.: US 6,843,069 B2
(45) Date of Patent: Jan. 18, 2005

(54) ETCHING APPARATUS

(75) Inventors: Hideki Harano, Kanagawa (JP); Hirofumi Seo, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 35 days.

(21) Appl. No.: 10/334,789

(22) Filed: Jan. 2, 2003

(65) Prior Publication Data

US 2003/0126872 A1 Jul. 10, 2003

(30) Foreign Application Priority Data

Jan. 10, 2002 (JP) ..... 2002-003440

(51) Int. Cl.[7] ..... F25D 17/02

(52) U.S. Cl. ..... 62/185; 62/201; 118/666; 438/5

(58) Field of Search ..... 62/201, 185, 180; 438/5; 700/121; 118/666

(56) References Cited

U.S. PATENT DOCUMENTS 6,427,462 B1 * 8/2002 Suenaga et al. ..... 62/201 Y 6,553,775 B2 * 4/2003 Togaru et al. ..... 62/133

FOREIGN PATENT DOCUMENTS

| | | |
|---|---|---|
| JP | 62-281423 | 12/1987 |
| JP | 09-172001 | 6/1997 |
| JP | 10-223499 | 8/1998 |
| JP | 2001-093883 | 4/2001 |
| JP | 2002-270579 | 9/2002 |

* cited by examiner

*Primary Examiner*—Harry B. Tanner
(74) *Attorney, Agent, or Firm*—Young & Thompson

(57) ABSTRACT

An etching apparatus of the present invention has a processing device having a reaction chamber in which an electrode provided with a built-in refrigerant-circulating path is installed, a refrigerator for cooling the refrigerant at a predetermined temperature and circulating the refrigerant in the refrigerant-circulating path at a predetermined flow rate, a controlling device for controlling the temperature or flow rate of the refrigerant, a status monitor for monitoring an operational status, and a temperature control device for controlling the temperature of the electrode by controlling the temperature or flow rate of the refrigerant on the basis of information about the operational status.

11 Claims, 2 Drawing Sheets

ETCHING APPARATUS

BACKGROUND OF THE INVENTION

1. Field of the Invention

The present invention relates to an etching apparatus, in particular an etching apparatus for control of the temperature depending on the operational status.

2. Description of the Prior Art

Reactive ion beam etching (RIE) apparatuses have been used for the etching pattern formation on substrates such as glass substrates and wafers (i.e., processing objects) in vapor phase. Among them, a plasma etching apparatus performs the etching pattern formation on a substrate placed on an electrode in a chamber using a plasma-generating reactive gas. In the process of etching pattern formation, the temperature of the substrate increases as radicals in the reactive gas come into collision with the surface of the substrate to proceed the chemical reaction thereon. The increase in the temperature of the substrate results in the deformation thereof, so that a trouble will be occurred in the process of micro-fabrication. Conventionally, for avoiding such a deformation, the temperature of the substrate is controlled using a cooling system in which a cooling mechanism is provided on the electrode to be used as a substrate mounting.

Referring now to FIG. 2, the configuration of the conventional cooling system is schematically illustrated. The conventional cooling system 120 is connected to a processing device 110 and is configured to take the heat from a substrate 160 in the device 110. In other words, a refrigerant stored in a refrigerant tank 122 is fed into the inside of an electrode 112 at a predetermined flow rate through a refrigerant-circulating path 121 by means of a pump 124. Then, the refrigerant in the electrode 112 absorbs heat to cool down the substrate 160 on the electrode 112. Subsequently, the heat-absorbing refrigerant is returned into the refrigerant tank 122 through the refrigerant-circulating path 121 and the refrigerant is then cooled down by a first heat exchanger 125 in the refrigerant tank 122, followed by using the refrigerant for cooling the substrate 160 again.

Here, in the refrigerating system 120, a temperature sensor 123 continuously monitors the temperature of the refrigerant in the refrigerant tank 122. A temperature controlling device 130 controls the flow rate of a gaseous refrigerant by a compressor 126 such that the temperature detected by the temperature sensor 123 can be coincident with a predetermined temperature to control the temperature or flow rate of the refrigerant in the refrigerant tank 122 through the first heat exchanger 125.

Regarding the process of etching pattern formation on the substrate 160 by the processing device 110, there is no need to extensively cool the substrate 160 because of no heat accumulation occurred therein before the initiation of such a process. In this case, that is, there is no direct heat load from the plasma to the electrode 112 before the initiation of the process. On the other hand, heat is gradually accumulated in the substrate when the substrate is continuously subjected to the etching process, so that the substrate should be cooled more extensively.

In the conventional cooling system, however, the flow rate of the refrigerant is maintained constant irrespective of whether the process is in an early state or in a final state. Therefore, there is a problem in which the temperature of the electrode is comparatively low when the number of processed substrates is small but it increases as the number of the processed substrates increases.

Regarding such a problem, for example, we measured the difference between the temperature of the substrate at the time of initiating the process of etching pattern formation on the first substrate and the temperature of the 22nd substrate at the time of initiating the process thereon, resulting in a temperature of 5.2° C. (i.e. 30° C. at the time of initiating the first etching process and 35.2° C. at the time of initiating the 22nd etching process). In addition, the difference between the temperature of the substrate at the time of completing the etching process on the first substrate and the temperature of the substrate at the time of completing the etching process on the 22nd substrate was 3.0° C. (i.e., 34.8° C. at the time of completing the first etching process and 37.8° C. at the time of completing the 22nd etching process).

Referring now to FIG. 3, furthermore, there is shown a graph that represents the relationship between the number of processed substrates and the shape difference (i.e., the amount of CD-shift [$\mu$m]) between the first substrate and the third or later substrate when the substrates were successively processed. Here, the term "CD-shift" means a value obtained by subtracting the line width of an etching mask before the process of etching pattern formation from the line width of an etching target material (i.e., each of the substrates) after the process. As shown in the figure, when the etching target material was a silicon oxide film (3.8 nm in film thickness), the CD shift was approximately 4 nm (the CD shift of the first one was −36 nm, while the CD shift of the third or later one was −40 nm). Such thermal variations of CD shift may affect on the micro-fabrication of a desired device.

Furthermore, when the processing device is out of action or is in an early state of the process, the cooling is excessively performed because the flow rate of the refrigerant for controlling the temperature of the electrode is substantially over the desired amount thereof. Therefore, there is another problem of the increase in electric power consumption because the flow rate of the refrigerant is maintained constant regardless of the usage pattern of the refrigerant when the device is in action or not.

BRIEF SUMMARY OF THE INVENTION

Summary of the Invention

An etching apparatus of the present invention comprises: a processing device having a reaction chamber in which an electrode provided with a built-in refrigerant-circulating path is installed; a refrigerator for cooling a refrigerant at a predetermined temperature and circulating the refrigerant in the refrigerant-circulating path at a predetermined flow rate; a controlling device for controlling the temperature or flow rate of the refrigerant; a status monitor for monitoring an operational status; and a temperature controlling device for controlling the temperature of the electrode by controlling the temperature or flow rate of the refrigerant on the basis of information about the operational status.

BRIEF DESCRIPTION OF THE DRAWINGS

The above-mentioned and other objects, features, and advantages of this invention will become more apparent by reference to the following detailed description of the invention taken in conjunction with accompanying drawings, wherein.

DETAILED DESCRIPTION OF THE INVENTION

Figure 1:
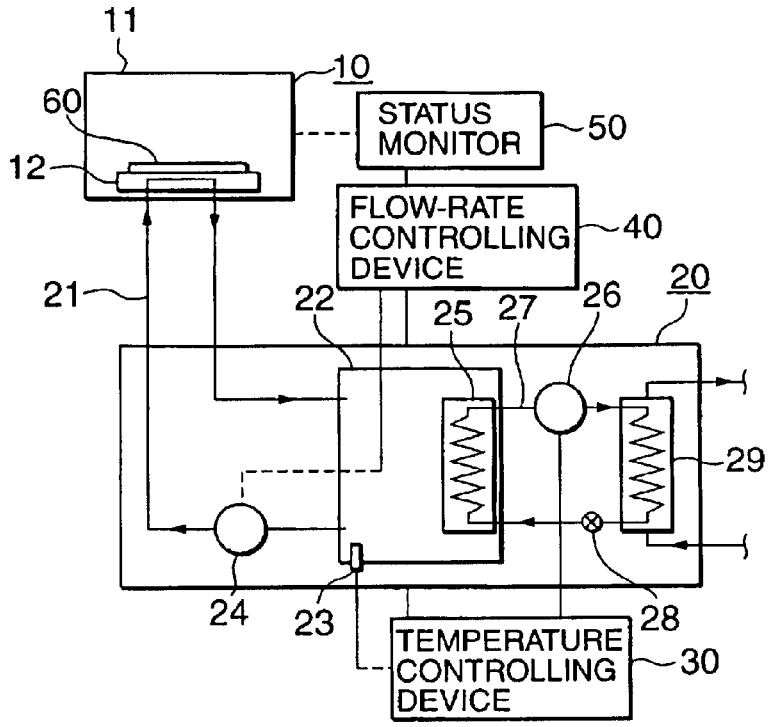
FIG. 1 is a block diagram that schematically illustrates the configuration of an etching apparatus in accordance with a first embodiment of the present invention.
Figure 2:
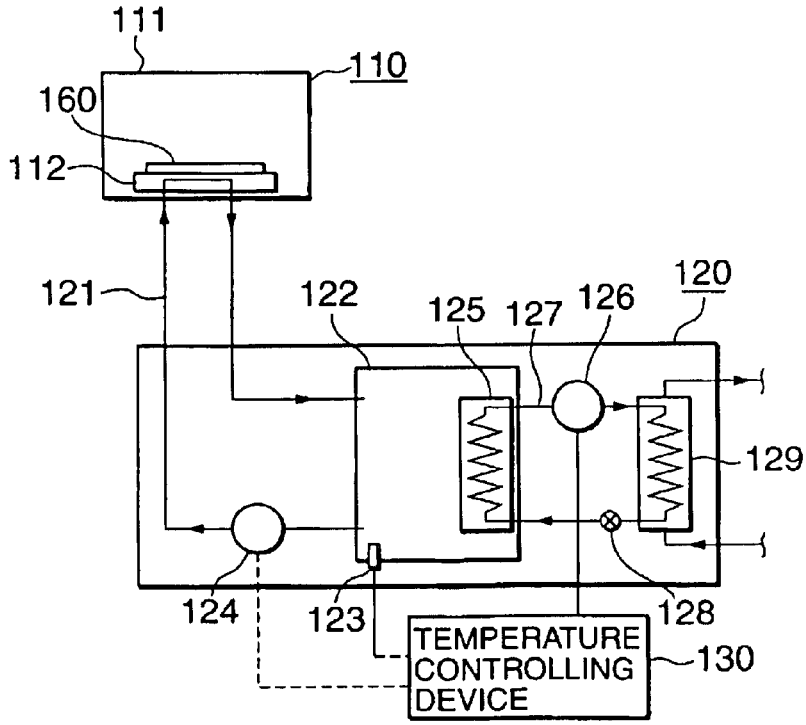
FIG. 2 PRIOR ART
FIG. 2 is a block diagram that schematically illustrates the configuration of an exemplified conventional etching apparatus.
Figure 3:
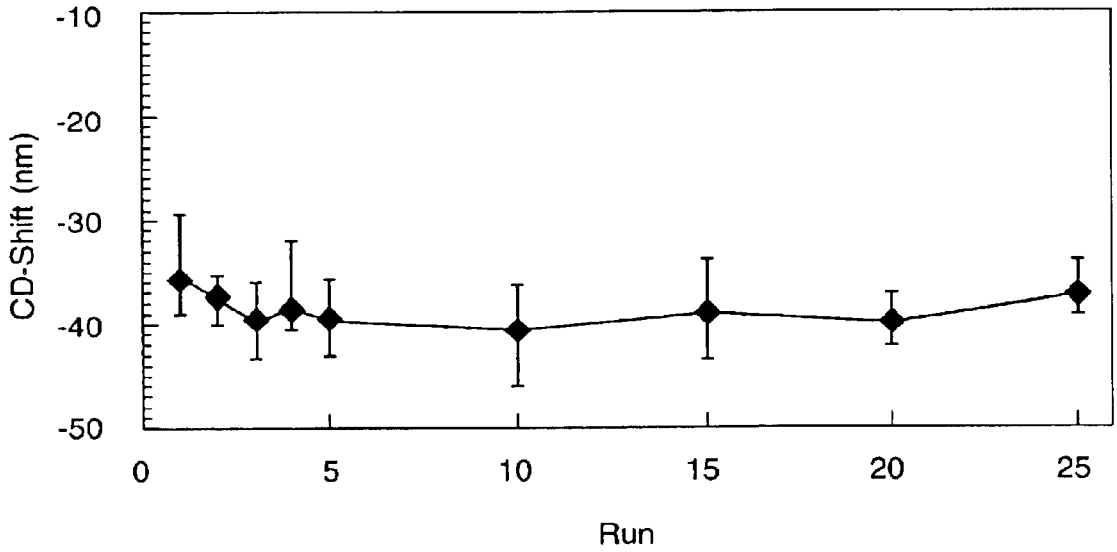
FIG. 3 PRIOR ART
FIG. 3 is a graph that represents the relationship between the number of processed substrates and the amount of CD shift when the substrates were successively processed.

Referring now to FIG. 1, we will describe the present invention with reference to FIG. 1. In this figure, there is schematically illustrated the configuration of an etching apparatus. The etching apparatus comprises: a processing device 10 having a reaction chamber 11 in which an electrode 12 provided with a built-in refrigerant-circulating path 21 is installed; a refrigerator 20 for cooling a refrigerant at a predetermined temperature and circulating the refrigerant in the refrigerant-circulating path 21 at a predetermined flow rate; a controlling device 30 or 40 for controlling the temperature or flow rate of the refrigerant; and a status monitor 50 for monitoring the operational status of the etching apparatus. In this etching apparatus, the process for controlling the temperature of such an apparatus in accordance with the present invention comprises the steps of: monitoring an operational status of the processing device 10 by the status monitor 50; controlling the temperature of the electrode 12 by controlling the temperature or flow rate of the refrigerant on the basis of the information about the obtained operational status. Therefore, it becomes possible to use the etching apparatus in an appropriate manner. In other words, the electrode 12 can be maintained at a constant temperature when the processing device 10 is in action (e.g., depending on the number of the target materials and the operation time of the processing device 10). In addition, the electrode 12 can be prevented from super cooling by attenuating or ceasing the cooling when the processing device 10 is out of action. Thus, the etching apparatus can be operated appropriately.

Referring again to FIG. 1, we will describe a first embodiment of the present invention. In this embodiment, an etching apparatus comprises: a processing device 10, a refrigerator 20, a temperature controlling device 30, a flow-rate controlling device 40, and a status monitor 50.

The processing device 10 is provided for performing the process of dry-etching pattern formation (i.e., plasma etching pattern formation) on a substrate 60 and is comprised of a reaction chamber 11 and an electrode 12.

The chamber 11 is provided as a reaction vessel for the etching pattern formation on the substrate 60, in which an upper electrode and a lower electrode (i.e., the electrode 12) are arranged in parallel so as to be opposite to each other.

The electrode 12 is a lower part of the electrode pair arranged in the chamber 11 and is provided as a mount on which a substrate 60 can be mounted. In the electrode 12, furthermore, a part of a refrigerant-circulating path 21 for maintaining the substrate 60 cool at a predetermined temperature is installed in the electrode 12.

The refrigerator 20 is provided as a cooling device having a mechanism for cooling the refrigerant. The refrigerant 20 comprises a part of the refrigerant-circulating path 21, a refrigerant tank 22, a temperature sensor 23, an inverter pump 24, a first heat exchanger 25, a compressor 26, a heat exchange path 27, a valve 28, and a second heat exchanger 29.

The refrigerant-circulating path 21 is provided as a flow channel through which the refrigerant can be circulated between the refrigerant tank 22 and the electrode 12. In other words, the refrigerant-circulating path 21 is provided as a flow channel having its inlet and outlet for the flow of refrigerant, which are respectively connected to the refrigerant tank 22. In addition, a part of the flow channel 21 is embodied in the electrode 12 such that it passes through the inside of the electrode 12 and the inverter pump 24 is attached on another part of the flow channel 21.

The refrigerant tank 22 is installed in the refrigerator 20 and is provided as a vessel for accumulating the refrigerant passed from the electrode 12 to cool it down. The refrigerant tank 22 includes the first heat exchanger 25, while the temperature sensor 23 is attached on the vicinity of the outlet of the refrigerant-circulating path 21. Thus, the refrigerant tank 22 is provided as a flow channel connected between the inlet and outlet of the refrigerant-circulating path 21.

The temperature sensor 23 is provided as a sensor for measuring the temperature of the refrigerant in the refrigerant tank 22 and makes an electrical connection to the temperature controlling device 30.

The inverter pump 24 is provided for circulating the refrigerant in the partway of the refrigerant circulating path 21. In addition, the inverter pump 24 is electrically connected to the flow-rate controlling device 40 and is controlled by such a device 40.

The first heat exchanger 25 is provided for cooling the refrigerant in the refrigerant tank 22 (i.e., for the heat absorption from the refrigerant).

The compressor 26 is provided for circulating the refrigerant in gaseous form in the partway of the ref rigerant-circulating path 21 and is capable of reducing the pressure on the side of the first heat exchanger 25, while pressurizing the side of the second heat exchanger 29. Furthermore, the compressor 26 is electrically connected to the temperature controlling device 30, so that the temperature of the compressor 26 can be controlled by the temperature controlling device 30.

The heat-exchange path 27 is a flow channel for circulating the gaseous refrigerant in the first and second heat exchangers 25, 29. In the partway of such a flow channel, the compressor 26 and the valve 28 are arranged. Thus, the compressor 26 reduces the pressure on the side of the first heat exchanger 25 and exerts pressure on the side of the second heat exchanger 29, while restricting the flow channel by means of the valve 28.

The valve 28 is arranged in the partway of the heat exchange path 27 to restrict the flow channel.

The second heat exchanger 29 is provided for cooling the gaseous refrigerant, in which a part of the heat exchange path 27 is installed. The first heat exchanger 25 absorbs heat from the refrigerant such that the heat of the gaseous refrigerant pressurized by the compressor 26 is absorbed by a cooling medium (such as cooled water) introduced from the outside of the refrigerator 20, followed by cooling the gaseous refrigerant to allow the cooling medium introduced from the outside of the refrigerator 20 to cool the gaseous refrigerant. Subsequently, the heat-absorbed cooling medium is forced out of the refrigerator 20 to the outside.

The temperature controlling device 30 is provided for controlling of the temperature of the refrigerant in the refrigerant tank 22. The temperature sensor 23 is electrically connected to the compressor 26 and the flow-rate controlling device 40. The temperature controlling device 30 obtains the information about the operational status from the flow-rate controlling device 40 in addition to obtain the information about the temperature detected by the temperature sensor 23. The obtained information is utilized to control the compressor 26 in accordance with a temperature control program which is defined in advance. Therefore, the temperature of the refrigerant can be adjusted to fit to the operational status. Here, the temperature control program is a program that controls the operation of the compressor 26 on the basis of heat load caused by plasma, the heat accumulation in the electrode 12 to be caused by such heat load, the number of substrates processed after the initiation of the process, the operation time of the etching apparatus, and so on, for adjusting the temperature of the refrigerant to fit to the operational status.

The flow-rate controlling device 40 is provided for automatically control the flow rate of the refrigerant in the refrigerant-circulating path 21 and is electrically connected to the inverter pump 24, the temperature controlling device 30, and the status monitor 50. The flow-rate controlling device 40 receives the information about the operational status from the status monitor 50. Then, it controls the operation of the inverter pump 24 on the basis of the received information about the operational status and the flow-rate control program defined in advance to adjust the flow rate of the refrigerant to fit to the operational status, while transmitting the information about the operational status to the temperature controlling device 30. The flow-rate control program controls the inverter pump 24 on the basis of the information about the operational status to adjust the flow rate of the refrigerant so as to be fit to such a status.

The status monitor 50 is provided for controlling a computer or the like that monitors the operational status of the processing device 10 and is electrically connected to the processing device 10 and the flow-rate controlling device 40. The status monitor 50 continuously or periodically collects the information about the operational status of the processing device 10, followed by sending such information to the flow-rate controlling device 40. Here, the above operational status information is of representing whether the processing device is in action or is out of action, including the number of substrates processed after the initiation of the action, the elapsed time from the initiation of the process (i.e., the time period in which the processing device 10 is in action), and the elapsed time from the completion of the process (i.e., the time period in which the processing device 10 is out of action).

Next, we will describe the operation of the dry etching apparatus in accordance with the first embodiment of the invention.

At first, the operation of the system when the processing device 10 is in action (i.e., during the period of successively processing the substrates. Each of the substrates 60 to be processed in the chamber 11 is placed on the electrode 12 and is then etched by plasma. For etching the substrate 60 in a stable manner, the temperature of the electrode 12 should be held constant. In an initial state of the operation, the electrode 12 is not subjected to the heat load caused by the plasma. In this case, there is no accumulation of heat, so that a high cooling ability may be not required. However, the etching apparatus requires a higher cooling ability as the accumulation of heat is gradually increased by successively processing the substrates. In this embodiment, therefore, the etching apparatus performs the process described below.

Here, the temperature sensor 23 continuously monitors the temperature of the refrigerant in the refrigerant tank 22 of the refrigerator 20. In addition, the temperature controlling device 30 controls the flow rate of the gaseous refrigerant in the compressor 26 such that the temperature of the refrigerant detected by the temperature sensor 23 is adjusted to a predetermined temperature. Thus, the temperature control device 30 adjusts the temperature of the refrigerant in the refrigerant tank 22 to the predetermined one through the first heat exchanger 25. Subsequently, the inverter pump 24 feeds the temperature-adjusted refrigerant from the refrigerant tank 22 to the electrode 12 in the chamber 11 through the refrigerant-circulating path 21.

Referring again to FIG. 1, at first, the status-monitor 50 acquires the information about the operation of the etching apparatus from the processing device 10 (in action) as information for maintaining the temperature of the electrode 12 in the chamber 11 at a predetermined temperature (Step A1). The information about the operation includes the number of substrates processed after the initiation of the process and the operation time of the etching apparatus.

Secondly, the status-monitor 50 transmits the information about the operation to the flow-rate controlling device 40 (Step A2).

Subsequently, the flow-rate controlling device 40 sends the received information about the operation to the temperature controlling device 30 (Step A3). Then, the flow-rate controlling device 40 allows the inverter pump 24 to sparingly feed the refrigerant in the early stage of the process in accordance with the information about the operation and the flow-rate control program, while allowing the inverter pump 24 to gradually increase the flow rate of the refrigerant as the number of the processed substrates (the operation time) increases (Step A4).

Finally, the temperature control device 30 receives the information about the operational status and the information about the temperature detected by the temperature sensor 23 to allow the compressor 26 to increase the flow rate of the gaseous refrigerant according to the temperature control program on the basis of the obtained information about the operational status and the information about the temperature (Step A5). Consequently, the temperature of the electrode 12 can be adjusted to be maintained at a predetermined temperature by the actions of the temperature control device 30 and the flow-rate controlling device 40.

Subsequently, the above steps A1 to A5 can be repeated as necessary.

Therefore, the difference between the temperature of the electrode in the early stage of the process and the temperature thereof in the stage of successively processing the substrates can be minimized when the processing device 10 is in action, so that a stable processing ability of the etching apparatus can be attained without depending on the number of the substrates to be processed.

Next, we will describe the action of the etching apparatus when the processing device 10 is out of action (i.e., during the period of without performing the etching on the substrate).

In the processing device 10, the etching process is not performed on the substrate. However, the temperature sensor 23 continuously monitors the temperature of the refrigerant in the refrigerant tank 22 in the refrigerator 20. In addition, the temperature controlling device 30 controls the flow rate of the gas refrigerant in the compressor 26 such that it corresponds to a predetermined temperature. Thus, the temperature of the refrigerant in the refrigerant tank 22 is adjusted through the first heat exchanger 25. Furthermore, the temperature-controlled refrigerant is fed from the refrigerant tank 22 to the electrode 12 of the chamber 11 by the action of the inverter pump 7 through the refrigerant-circulating path 21. If the chamber 11 is out of action, there is no refrigeration load caused by plasma. In this case, therefore, the following steps will be alternatively performed.

At first, the status-monitor 50 acquires the information about the operational status in which the processing device is out of action from the processing device (being out of action) as the information for maintaining the electrode 12 in the chamber 11 at a predetermined temperature (Step B1). The information about non-operational status includes the information about the elapsed time from the completion of the process.

Next, the status-monitor 50 transmits the information about the operational status in which the processing device is out of action to the flow-rate controlling device 40 (Step B2).

Subsequently, the flow-rate controlling device 40 transmits the received information about the operational status in which the processing device is out of action to the temperature controlling device (Step B3), followed by lowering the flow rate of the refrigerant by the inverter pump 24 in accordance with the flow-rate control program on the basis of the information about the operational status in which the processing device is out of action (Step B4).

Finally, the temperature controlling device 30 receives the information about the operational status in which the processing device is out of action and the information about the temperature detected by the temperature sensor 23 to lower the flow rate of the gaseous refrigerant by the compressor 26 in accordance with the temperature control program on the basis of the information about the operational status in which the processing device is out of action and the information about the temperature (Step B5).

Consequently, power consumption can be reduced by lowering the refrigerating ability of the refrigerator when the etching device is out of action.

As described above, depending on the operational status, the power consumption of the inverter pump 24 and the compressor 26 can be minimized by appropriately controlling the temperature of the electrode 12 and the flow rate of the refrigerant.

For lowering the power consumption in an alternative manner, a second embodiment of the present invention will be described. In this embodiment, on the basis of the information about the operational status in which the processing device is out of action transmitted from the processing device, the refrigerator stops the flow of the refrigerant from the refrigerator to the electrode on which there is no refrigeration load to be caused by plasma when the etching apparatus is out of action (in the idle state). Therefore, the refrigerator is deactivated, so that power consumption can be lowered.

Although the invention has been described with reference to specific embodiments, this description is not meant to be construed in a limiting sense. Various modifications of the disclosed embodiments will become apparent to persons skilled in the art upon reference to the description of the invention. It is therefore contemplated that the appended clams will cover any modifications or embodiments as fall within the true scope of the invention.

What is claimed is:

1. An etching apparatus comprising:

a processing device having a reaction chamber in which an electrode provided with a built-in refrigerant-circulating path is installed;

a refrigerator for cooling the refrigerant at a predetermined temperature and circulating the refrigerant in the refrigerant-circulating path at a predetermined flow rate;

a controlling device for controlling the temperature or flow rate of the refrigerant;

a status monitor for monitoring an operational status; and a temperature controlling device by which the temperature of the electrode is controlled so as to be held constant by gradually increasing the flow rate of the refrigerant in proportion to the increase in the number of processed target materials on the basis of the information about the operational status indicating that the processing device is in action, and by which the circulation of the refrigerant is lowered on the basis of information about the operational status indicating that the processing device is out of action when the processing device is out of action.

2. An etching apparatus as claimed in claim 1, wherein the information about the operational status includes information about the number of the processed target materials which are processed after the initiation of the operation.

3. An etching apparatus comprising:

a processing device having a reaction chamber in which an electrode provided with a built-in refrigerant-circulating path is installed;

a refrigerator for cooling the refrigerant at a predetermined temperature and circulating the refrigerant in the refrigerant-circulating path at a predetermined flow rate;

a controlling device for controlling the temperature or flow rate of the refrigerant;

a status monitor for monitoring an operational status; and a temperature controlling device by which the temperature of the electrode is controlled so as to be held constant by gradually increasing the flow rate of the refrigerant in proportion to the increase in the number of processed target materials on the basis of the information about the operational status indicating that the processing device is in action.

4. An etching apparatus as claimed in claim 3, wherein the information about the operational status includes information about the number of the processed target materials which are processed after the initiation of the operation.

5. An etching apparatus comprising:

a processing device;

an electrode provided in said processing device to hold a substrate to be processed;

a refrigerant path through which a refrigerant flows, a part of said refrigerant path being installed in said electrode;

a flow valve coupled to said refrigerant path to control a flow rate of said refrigerant; and a control device coupled to said flow valve to vary the flow rate of said refrigerant while said processing device is being activated to work.

6. The etching apparatus according to claim 5, wherein said processing device performing an etching operation on a plurality of said substrate while said processing device is being activated, said control device controls said flow valve to increase the flow rate of said refrigerant in accordance with increase in number of said substrate.

7. The etching apparatus according to claim 6, further comprising a status monitor monitoring an operational status of said processing device and supplying said control device with information which represents that said processing device is being activated to work.

8. The etching apparatus according to claim 7, further comprising a temperature control device coupled to said refrigerant path to control a temperature of said refrigerant in response to a signal supplied from said status monitor.

9. An etching apparatus comprising:

a processing device;

an electrode provided in said processing device to hold a substrate to be processed;

a refrigerant path through which a refrigerant flows, a part of said refrigerant path being installed in said electrode;

a flow valve coupled to said refrigerant path to control a flow rate of said refrigerant; and a control device coupled to said flow valve to control the flow rate of said refrigerant, said control device responding to said processing device being out of action and controlling said flow valve to allow said refrigerant to continue flowing through said refrigerant path at such a rate that is lower than a flow rate of when said processing device is being in action.

10. The etching apparatus according to claim 9, wherein the flow rate being in action of said processing device is varied.

11. The etching apparatus according to claim 10, wherein the flow rate being in action of said processing device is varied in accordance with increase in number of said substrate.

* * * * *